United States Patent [19]

Schuster et al.

[11] 4,019,719

[45] Apr. 26, 1977

[54] FLUID MIXING DEVICE

[76] Inventors: Hans H. Schuster, 166 Luitpoldstrasse; Peter Zehner, 11 Alwin-Mittasch-Platz, both of 6700 Ludwigshafen, Germany

[22] Filed: Apr. 1, 1976

[21] Appl. No.: 672,612

[30] Foreign Application Priority Data

June 5, 1975 Germany ..... 2525020

[52] U.S. Cl. ..... 259/4 AB; B01F/15/02

[51] Int. Cl.[2] ..... B01F 5/00

[58] Field of Search ..... 259/4 R, 4 A, 4 AB, 259/4 AC, 18, 36; 138/38, 42; 239/432, 488

[56] References Cited

UNITED STATES PATENTS

| | | | |
|---|---|---|---|
| 3,051,453 | 8/1962 | Sluijters | 259/4 AB |
| 3,239,197 | 3/1966 | Tollar | 259/4 AC |
| 3,286,992 | 11/1966 | Armeniades | 259/4 AB |
| 3,406,947 | 10/1968 | Harder | 259/4 AB |
| 3,620,506 | 11/1971 | Stephen | 259/4 AB |
| 3,652,061 | 3/1972 | Chisholm | 259/4 AC |
| 3,923,288 | 12/1975 | King | 259/4 AB |

*Primary Examiner*—Robert W. Jenkins
*Attorney, Agent, or Firm*—Johnston, Keil, Thompson & Shurtleff

[57] ABSTRACT

An apparatus for thoroughly mixing components of fluid material and, more particularly, for combining and homogenizing streams of gaseous, liquid and/or granular material by passage through a tube-like conduit which contains a plurality of consecutive mixing elements comprising a set of stationary, angularly disposed flow-deflecting baffles of particular form and configuration which cause a repeated dividing, displacement and recombining of the fluid stream and thereby provide improved radial mixing and approximation of ideal plug flow.

11 Claims, 10 Drawing Figures

FLUID MIXING DEVICE

BACKGROUND OF THE INVENTION

The present invention relates generally to a means for mixing a plurality of components of fluid material. Devices of this type are known in the mixing art as static mixers. Such mixers are generally obtained by providing a tortuous path for the fluid streams to be homogenized or blended through the use of stationary baffles or other flow diverting structures of differing form and spatial arrangement within a flow bounding conduit or passageway.

Several designs of static mixing devices are known and are set forth, for example, in U.S. Pat. Nos.: 3,051,452, Nobel et al; 3,182,965, Sluijters; 3,239,197, Tollar; 3,286,992, Armeniades et al; 3,297,305, Walden; 3,358,749, Chisholm et al; 3,404,869, Harder; 3,583,678, Harder; 3,652,061, Chisholm; German Pat. No. 358,018, Burckhardt; and French Pat. No. 735,033, all of which are herewith incorporated by reference. Static mixing devices are further discussed in the following publications:

Pattison, *Chemical Engineering*, (May 1, 1969) p.94 et seq.;

Brunemann, *Maschinenmarkt, Wurzburg*, 79 (1973) 10, pp. 182–84;

Schilo, Ostertag, *Verfahrenstechnik*, 6 (1969) 2, pp. 45–47;

Brunemann, John, *Chemie-Ing.Techn.*, 43 (1971) 6, pp. 1051–56;

Hartung, Hiby, Chemie-Ing. Techn., 44 (1972) 18, pp. 1051–56;

Hartung, Hyby, *Chemie-Ing.Techn.*, 47 (1975) 7, pp. 309.

Often the flow-deflecting structure of these mixing devices consist of complicated, not easily manufactured configurations requiring casting, molding or extensive machine work or the like for preparation such as, for instance, those disclosed in U.S. Pat. Nos. 3,239,197; 3,404,869, and 3,583,678. Others are prepared by deformation of tubes, such as by crimping, as disclosed in U.S. Pat. Nos. 3,358,749 and 3,394,924, which most often is suitable for mixers employing low pressure and relatively small diameters only. U.S. Pat. No. 3,286,992 discloses a mixing device consisting of a plurality of helically wound, sheet-like elements which are longitudinally arranged in a tube in alternating left- and right-handed curvature groups. According to pertinent literature, one of the disadvantages of this kind of design is the dependency of its efficiency on a relatively limited range of length-to-diameter ratios of its elements, thereby causing a relatively large minimum length of the mixing apparatus. It has also been found that this design produces a lack of uniformity of mixing over the entire crossection (hole-in-the-center effect) under certain conditions and that the curved shape of the elements in larger diameter sizes is quite difficult to economically manufacture. Other prior art devices employ a plurality of plates or vanes extending outwardly from a central point of the tube, said vanes being angularly disposed in the manner of propeller blades, by which fluid striking the vanes will have imparted to it a swirling movement, with successive swirling means arranged to reverse the swirling movement of the fluid, the latter being achieved by giving opposite slopes to each succeeding set of vanes. Such a device is, for instance, disclosed in U.S. Pat. No. 3,652,061.

These devices, however, have the disadvantage of requiring either slotting of the tube for inserting and affixing the vanes to it or the addition of a rod-like structure for supporting the vanes within the conduit.

BRIEF DESCRIPTION OF THE INVENTION

The present invention overcomes the above-described disadvantages found with the prior art static mixing devices while at the same time showing good mixing efficiency even in case of large viscosity differences of the components and concurrently yielding good approximation of ideal plug flow. Furthermore, the design of the apparatus of the present invention is relatively simple so as to allow easy and economical manufacturing, particularly of larger diameter sizes.

The present invention solves these problems by arranging mixing elements of equal shape and configuration, one after another, in a tube-like structure. Each mixing element consists of an outer and an inner flow-deflecting baffle whose respective minor axes are normal to the longitudinal axis of the tube or conduit, while the major axes are angularly disposed with respect to each other and to the longitudinal axis of the tube or conduit. The outer baffle has a circumferential boundary contour that is substantially in contact with and slidingly fits the internal surface of the tube or conduit, and has an orifice-like inner opening inside of which the inner baffle is positioned in such a way that respective minor axes of both baffles preferably coincide.

In a preferred execution of the present invention, the inner baffle is equal or similar in its form to that of the orifice-like opening of the outer baffle. In another preferred embodiment of the invention the coinciding minor axis of the inner and the outer baffles represent a boundary line of the mixing element and the two baffles form an angle which includes the longitudinal axis of the tube or conduit.

Furthermore, the elements may be advantageously arranged in such a way that an outer baffle of one element faces an inner baffle of the adjacent element and vice versa, that is, successive elements are alternatingly disposed by 180° around the longitudinal axis of the tube or conduit.

According to a further characteristic feature of the invention, the mixing elements are emboxed and interlocked with each other by the inner baffle of one mixing element partly penetrating the inner opening of an adjacent element.

It can also be advantageous to have an additional flow-guiding surface extending parallel along the longitudinal axis of the tube or conduit from the boundary line of the element that is normal to the axis of the tube whereby one side of this additional flow-guiding surface is approximately equal to the internal diameter of the tube while its physical dimension in the direction of the axis of the tube is preferably between 0.1 to 0.5 times the internal diameter of the tube.

As an additional feature of the invention, opposing flow-guiding surfaces of adjacent elements have at least one slot in one of the flow-guiding surfaces at their point of contact, so that the two flow-guiding surfaces partly penetrate each other, when assembled. The invention is further characterized by the boundary line of the mixing element, which is normal to the longitudinal axis of the tube or conduit, having a sharp, knife-like edge.

Therefore, the advantages of the present invention over prior art may be summarized as being the simplicity of its design which allows easy, economical manufacturing, particularly of larger diameter sizes; its self-supporting baffle structure which does not necessarily require the baffles to be affixed to the external conduit or to supporting rods or other additional structures; its particular mode of operation which yields improved radial mixing efficiency that results in a relatively narrow residence time distribution of the elements of the fluid flow, thereby providing an improved approximation of ideal plug flow which is desired in many cases of process and reaction engineering; and its improved ability for mixing fluid components of largely differing viscosities.

BRIEF DESCRIPTION OF THE DRAWINGS

In the annexed drawings

DETAILED DESCRIPTION OF THE INVENTION

Figure 1:
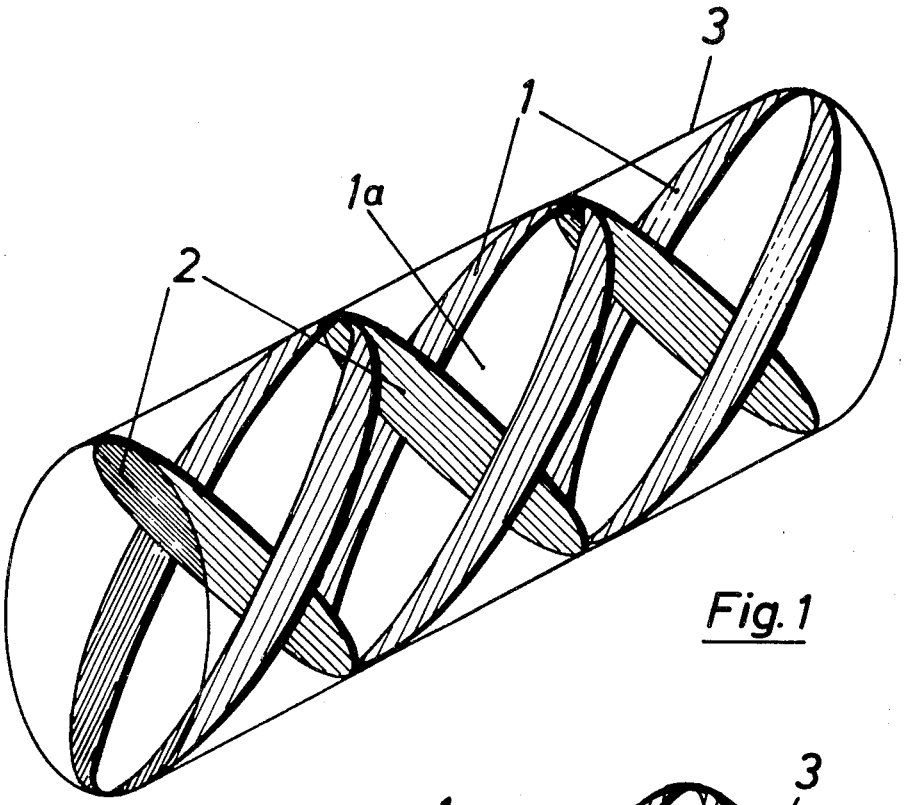
FIG. 1 is a perspective view of a simple embodiment of the present invention.
Figure 2:
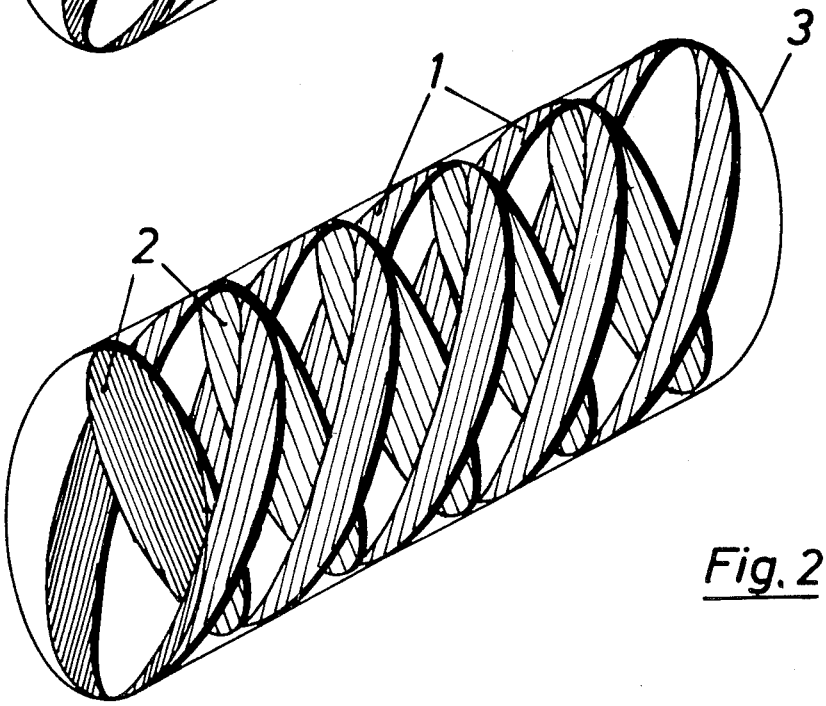
FIG. 2 is a perspective view of an embodiment as in FIG. 1, with the variation of baffles having a different angular configuration.

FIGS. 1 and 2 illustrate relatively simply embodiments of the present invention consisting of tube 3 having an inlet end 11 and an outlet end 12 and containing, one after another, a plurality of mixing elements each having an outer baffle 1, an internal opening 1*a* and an inner baffle 2. With the preferred use of plane baffling surfaces, one obtains with a hollow cylindrical tube the peripheral contour of outer baffle 1 as being the line of intersection of a plane with the inner surface of cylindrical tube 3, i.e., an ellipse whose minor axis is equal to the internal diameter of tube 3 and whose major axis is determined by the chosen angle of attack with respect to the main flow direction. It has been found that this angle may be between 10° and 80° and preferably between 30 and 60.

Orifice-like opening 1*a* of the outer baffle 1 also is preferably in the shape of an ellipse having a minor axis length of between 0.05 and 0.7 times, preferably 0.4 to 0.6 times, the internal diameter of tube 3. The length of the major axis of this elliptical opening is preferably about equal to the length of the major axis of outer flow-guiding surface 1.

Inner baffle 2 located within the orifice-like inner opening 1*a* of outer baffle 1 is preferably also formed in the shape of an ellipse whereby the minor axis of the inner and outer baffles coincide. The length of the minor axis of inner baffle 2 is between 0.3 and 0.95 times, preferably between 0.4 and 0.6 times, the internal diameter of tube 3. If the length of the minor axis of inner baffle 2 is larger than the inner orifice-like opening 1*a*, it is necessary to provide appropriate slotting of outer baffle 1 for the inner baffle 2 to be inserted. The length of the major axis of inner baffle 2 is preferably equal to the length of the major axis of outer baffle 1.

Figure 4:
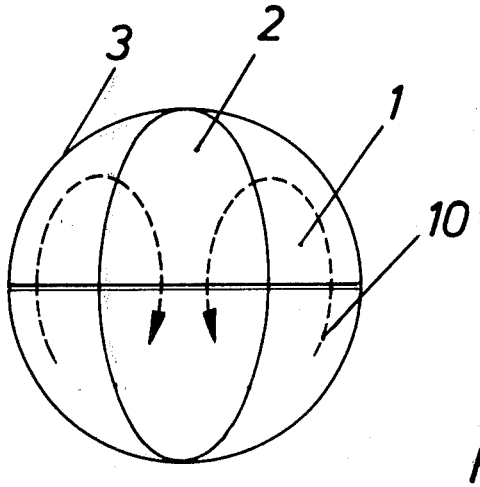
FIG. 4 is a schematic representation of the rotational flow pattern developed when the axial fluid flow impinges upon a mixing element according to FIGS. 1 to 3.

By arranging outer baffle 1 and inner baffle 2 of each mixing element in the previously described, angularly disposed way, elements of the fluid stream moving near the inner wall of tube 3 will be diverted towards the center of the tube, while respective fluid elements moving near the center of tube 3 will be diverted towards the wall of tube 3. Since this motion of the fluid is superimposed on the main flow parallel to the longitudinal axis of the tube, several substreams 10 are necessarily formed that follow different, helix-like flow paths which have an opposite rotational movement with respect to each other. The desired radial mixing obtained this way is schematically shown in FIG. 4. Since all fluid elements of the flow follow simiar flow lines, the length of the mean flow path and, hence, the mean residence time for each individual fluid element to pass through the mixing apparatus of the present invention is, as desired, approximately equal.

Figure 3:
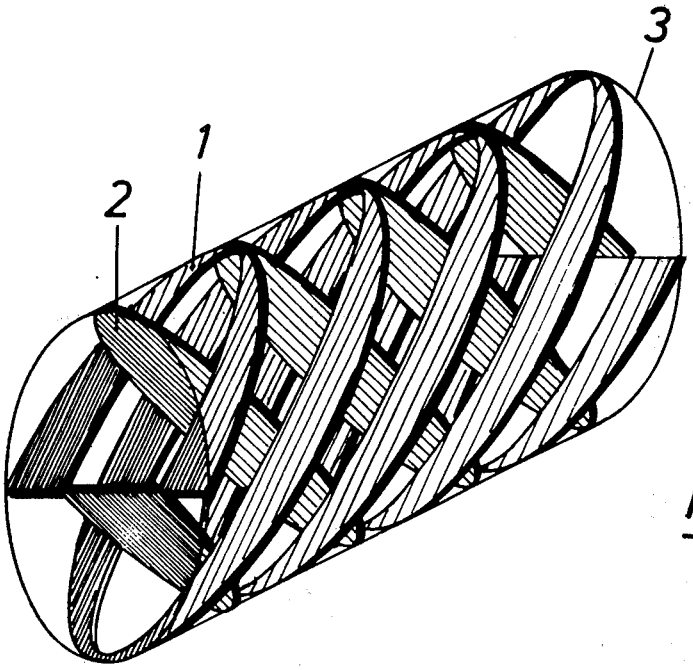
FIG. 3 is a perspective view of an embodiment as in FIG. 1, with the variation of baffles longitudinally emboxing adjacent mixing elements.

By use of this mixing apparatus for the purpose of obtaining a narrow residence time distribution of the elements of the fluid stream, it is advantageous to position successive mixing elements with respect to each other in such a way that the baffle area vector components normal to the longitudinal axis of the tube remain constant for respective baffles of successive elements. That is, the mixing elements are positioned with respect to each other without angular disposition about the longitudinal axis of the tube 3. In this way the opposite rotation of the helix-like motion of the different substreams is maintained along the entire length of the mixing apparatus. This arrangement is, for instance, shown in FIG. 1 and 2. A further improvement of the described radial mixing action is obtained by emboxing the mixing elements in such a way that inner baffle 2 partially penetrates the orifice-like opening 1*a* of the adjacent mixing element. This feature is shown in FIG. 3.

Figure 5:
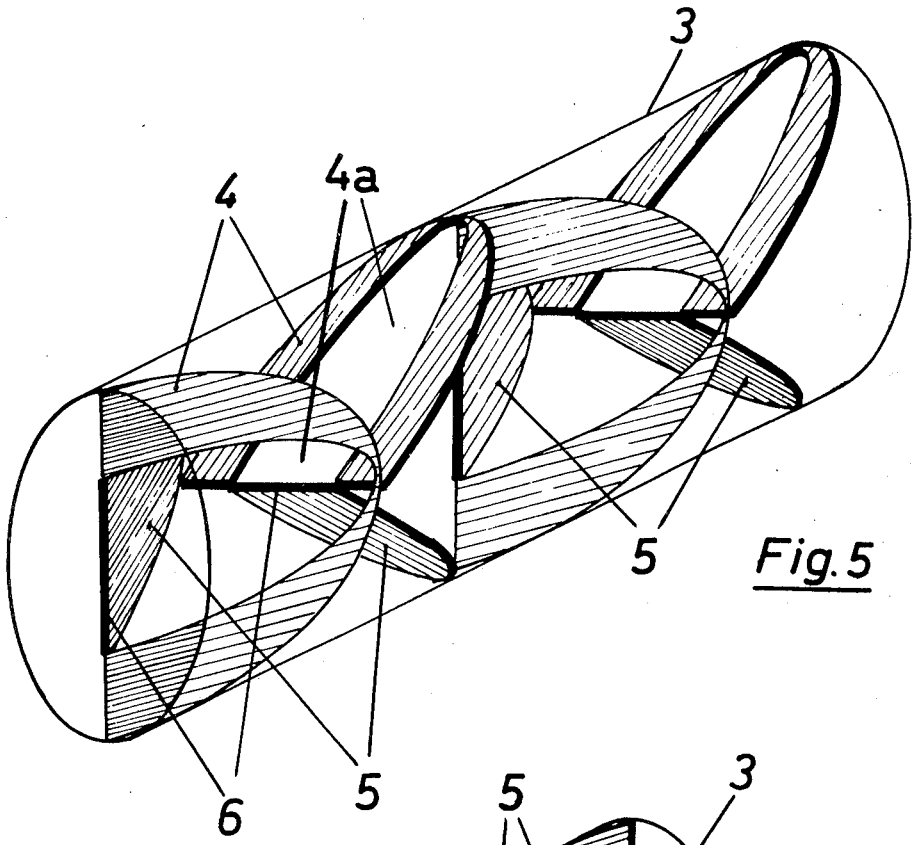
FIG. 5 is a perspective view of an alternative embodiment of the invention.

The invention is furthermore particularly suitable for mixing and homogenizing of fluid matter, especially of relatively viscous, paste-like materials. For this purpose it is advantageous to use mixing elements that are obtained when the previously described elements depicted in FIG. 1 and 2 are divided along the mutual minor axis of outer baffle 1 and inner baffle 2 in a manner such that the minor axis becomes a boundary line 6 of the mixing element. FIG. 5 depicts these elements as having a hemielliptical shape at baffles 4 and baffles 5. These mixing elements are positioned in tube 3 so that boundary line 6 of each mixing element is pointing into the upstream direction of the main flow and that successive elements are angularly disposed with respect to each other, preferably by an angle of about 90°.

Figure 6:
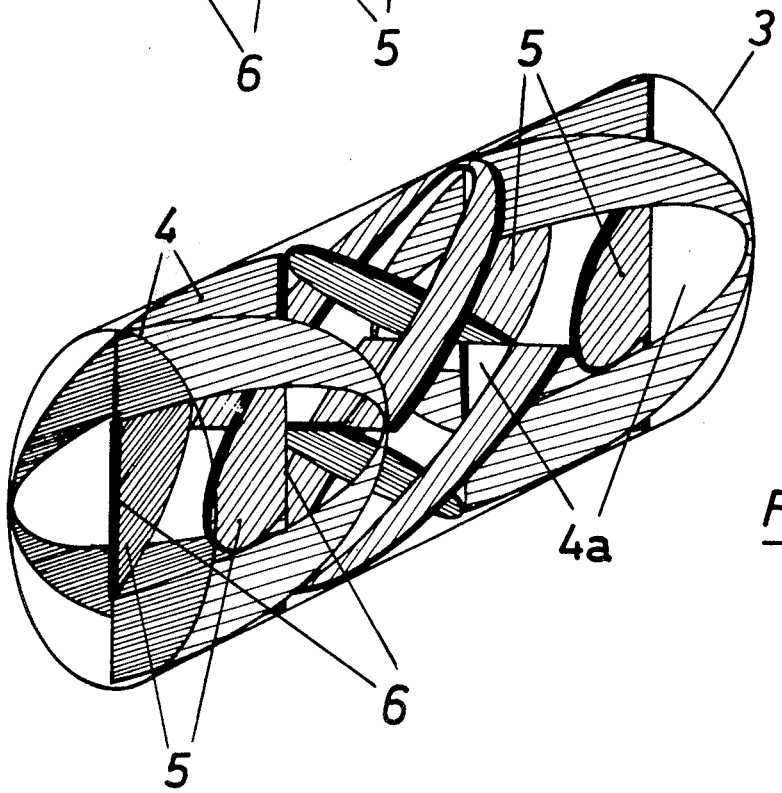
FIG. 6 is a perspective view of an embodiment as in FIG. 5, with the variation of each two elements being longitudinally emboxed to form a new combined mixing element.

A further increase in mixing action with mixing elements consisting of hemiellipitcal baffles 4 and 5 can be attained by arranging the elements according to FIG. 6, that is, by emboxing two elements into each other so that each inner baffle 5 of one element penetrates the internal opening 4*a* of outer baffle 4 of the other element. Boundary lines 6 will be located at opposite ends of this composite new element and they will lie within in a mutual plane parallel to the longitudinal axis of tube 3.

The mixing elements may consist of loosely fitted, separable pieces, but it is advantageous to increase the mechanical rigidity and structural strength of the configuration by permanently joining the various baffles at their mutual points of contact, for instance, by brazing, welding or glueing. The baffles are easily manufactured, for example, by punching out of plate metal or cutting of stacked sheets of material and bending them to the required shape. Depending on the particular application and the required mechanical strength of the mixer design, appropriate non-metal materials such as polyolefines, polyvinylchloride, polyacetales and polyamides may also be used as construction materials.

Figure 7:
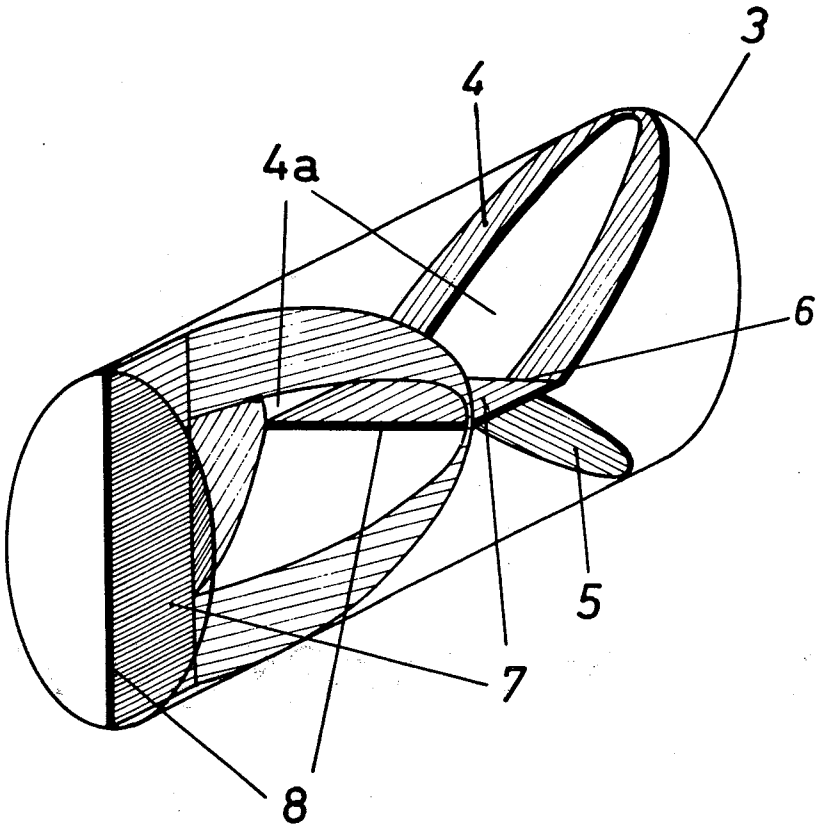
FIG. 7 is a perspective view of an embodiment as in FIG. 5, with the variation of an added flow-guiding surface.

FIG. 7 shows an improvement of the mixing element configuration depicted in FIG. 5. For fluid dynamical reasons and for improved ease of manufacturing, it may be advantageous to have an additional, preferably rectangular, flow-guiding baffle 7 extending from boundary line 6 of the mixing elements of FIG. 5 in the upsteam direction parallel to the longitudinal axis of tube 3. The length of this rectangular baffle piece 7 in the direction of the longitudinal axis of tube 3 may be between 0.1 to 0.5 times the internal diameter of tube 3 and its width should practially be equal to the internal diameter of tube 3.

Figure 8:
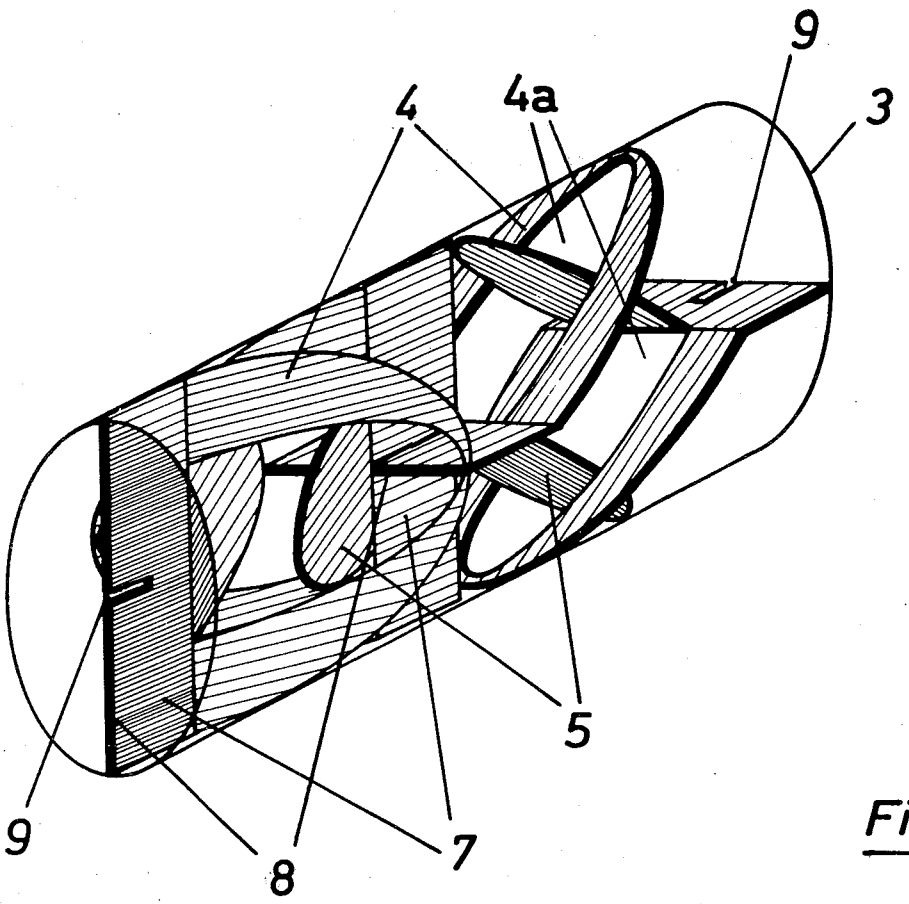
FIG. 8 is a perspective view of an embodiment as FIG. 6, with the variation of an added flow-guiding surface having an axial slotting.

By analogously applying this concept of baffle piece 7 to the mixing elements depicted in FIG. 6, one obtains an improved embodiment of the invention that is shown in FIG. 8, whereby fixing of the relative position of adjacent elements is attained by providing baffles 7, at the point of intersection of boundary lines 8 of opposite mixing-elements, with a slot 9 whose width is suitably just large enough for inserting the opposite baffle 7 of the other element. The depth of slot 9 in the direction of the longitudinal axis of tube 3 is preferably between 0.2 to 0.5 times the length of baffle piece 7 in the longitudinal direction of tube 3. By partially inserting adjacent mixing elements into each other by means of said slotting 9, a relative displacement of the mixing elements by rotational motion about the longitudinal axis of tube 3 can substantially be limited. Again, the mechanical rigidity and structural strength of the mixing apparatus can be improved by permanently joining adjacent baffles at their mutual points of contact, for instance, by brazing, welding or glueing. This can be applied to any point of baffle-to-baffle contact, including interconenction of successive elements, or be limited to baffles of the individual element only.

For application of the previously described mixing devices with agglomerates or other particulate matter containing fluid materials, as for example in a sewage treatment processes, it can be advantageous to give boundary lines 6 or 7 the form of sharp, knife-like edges.

Figure 9:
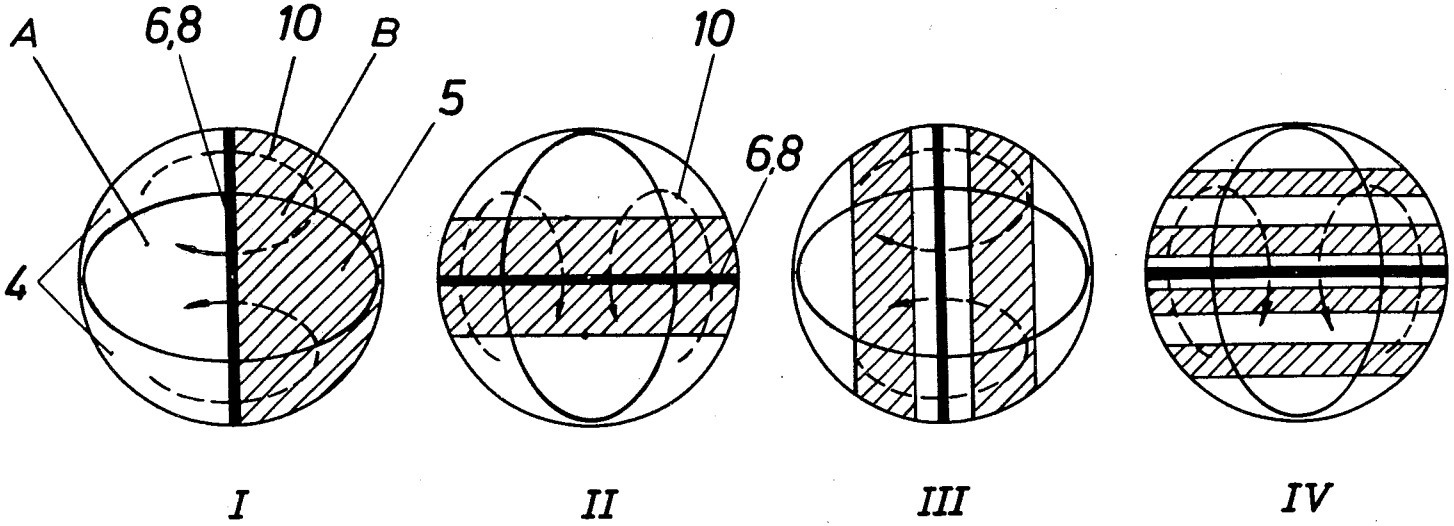
FIG. 9 is a crossectional view of the entrance plane of the first four consecutive mixing elements of the type depicted in FIGS. 5 and 7, illustrating schematically the mechanism of layer formation as fluid streams pass consecutive mixing elements.

The operating principle of devices depicted in FIGS. 5 through 8 is schematically represented in FIG. 9. Assuming that two different, viscous fluid streams are flowing towards the upstream end of mixing element I, the two fluids being separated by an impermeable wall extending along the longitudinal axis of the tube parallel to the boundary line 6 or 8 of the first mixing element or the first baffle 7, respectively, thereby forming flow regions A and B ahead of the first mixing element which do not allow the two fluids to intermingle. FIG. 9(I) through 9(IV) show schematic cutaway views of the mixing apparatus and the fluid streams at the respective upstream entrance plane of mixing elements I through IV. With the impingement of fluid streams A and B on baffles 4 and 5 of mixing element I, rotational fluid motions 10 are induced that are superimposed on the translatory axial main flow and that have a rotational direction towards the left near the longitudinal axis of the mixing element, thereby causing a dividing and displacement of the fluid stream, originally flowing in regions A and B, to take place. Upon reaching the following mixing element II which is angularly disposed, preferably by about 90° with respect to the trailing boundary line 6 or 8 of element I, respectively, the fluid streams are forced again into a rotational motion with a downward direction near the longitudinal axis of the mixing element and a renewed dividing and displacement of the fluid streams entering the mixing element takes place. This process is accordingly repeated in the following mixing elements III, IV and so on.

From the schematic representation of the mode of action of the invention in FIG. 9, the regularity of new formation of layers within the fluid flow becomes evident. Since with every passing of another mixing element the number N of interfaces between the fluid layers A and B theoretically doubles, mathematically after *n* mixing elements the following number of interfaces (N) are formed:

$$N = 2^n.$$

The number (M) of theoretically formed fluid layers A and B is accordingly:

$$M = 2^n + 1.$$

The general operating priniciples and advantages of the present invention will now be further discussed by means of the following examples:

EXAMPLE 1

Residence time characteristics:

The residence time behavior of the mixing apparatus of the present invention was compared to that of the empty, smooth pipe and a static mixing device as described in U.S. Pat. No. 3,286,992 consisting of a plurality of helically wound, sheet-like elements longitudinally arranged in alternating left- and right-handed curvature groups.

The apparatus used for comparative testing consisted of a 500 mm long precision glass tube of D =17.2 mm internal diameter, which was jacketed for thermostate temperature control. For each test the glass tube was equipped with the following type of mixing elements:

| | | |
|---|---|---|
| a) mixing elements according to FIG. 1 of this invention | | |
| number of mixing elements | 23 | |
| length of major axis of baffles 1 and 2 | 27.5 | mm |
| length of minor axis of baffle 1 | 17.0 | mm |
| length of minor axis of orifice-like opening 1a and baffle 2 | 8.0 | mm |
| b) mixing elements according to U.S. Letter Patent No. 3,286,992 | | |
| number of elements | 19 | |
| outer diameter | 17.0 | mm |
| major axis of baffle 4 and 5 | 36.6 | mm |
| minor axis of baffle 4 | 42.0 | mm |
| minor axis of the internal opening 4a and of baffle 5 | 21.0 | mm |

By means of a precise fluid metering pump the vertically mounted mixing device was charged from bottom up with deionized water at a rate of 1000 ccm/hour. At a time $t = t_0$ the feed to the mixing device was at an always constant flow rate, changed to a one percent aqueous solution of potassium chloride. After exactly 60 seconds the feed was switched back again to deionized water. The residence time behavior of the respective mixing device was then characterized by the response of the system to this electrolyte concentration "slug" input and was monitored by measurement of the electric conductivity at the downstream end of the mixing device, which is equivalent to the electrolyte concentration at this point, as a function of time elapsed after $t = t_0$.

Figure 10:
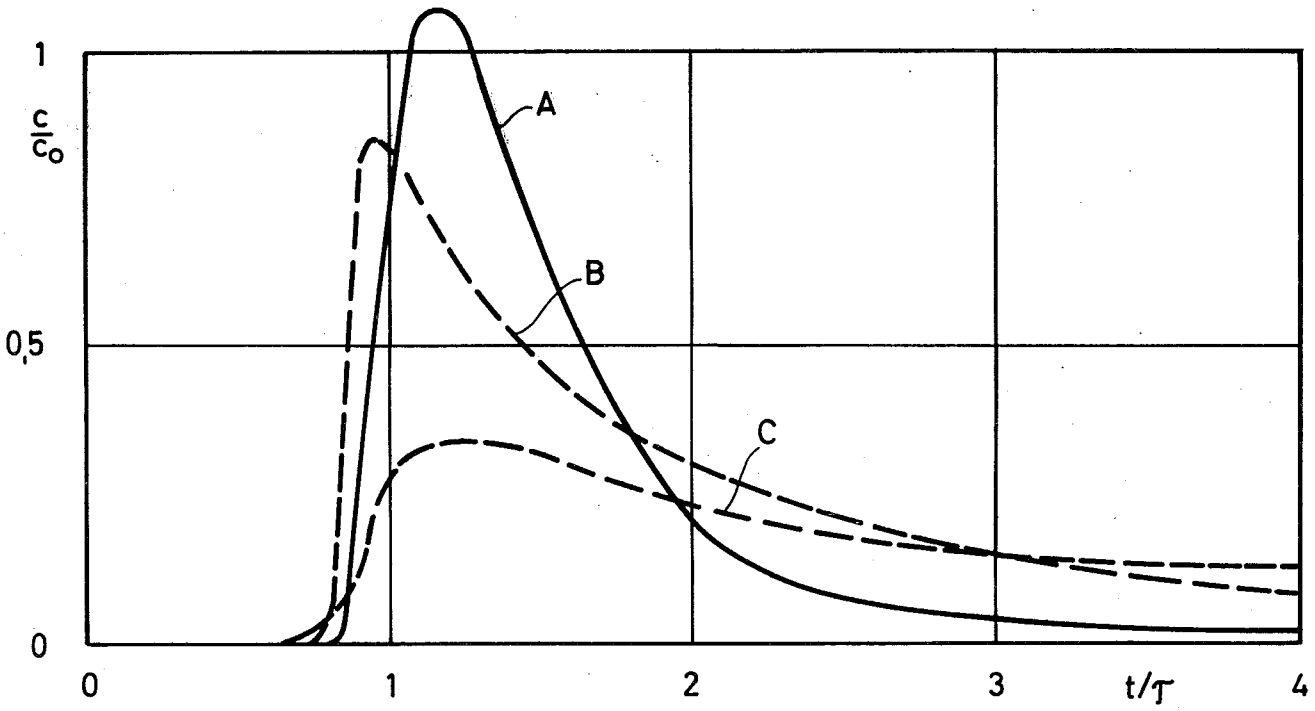
FIG. 10 is a plot of residence time distribution functions, meaning the normalized responses to a "slug" tracer input as the function of a normalized time, obtained with a mixing device according to FIG. 1 of the invention (Curve A), a mixing device according to U.S. Pat. No. 3,286,992 (Curve B) and with the empty pipe (Curve C).

A plot of the effluent electrolyte concentration versus time, also called residence time distribution function is, in non-dimensional form, shown in FIG. 10. Non-dimensionalizing or normalization of the abscissa was done by dividing the actually measured time by the mean residence time, which is defined as the quotient of the liquid volume content (ccm) of the respective mixing device and the volumetric flow rate of the feed (ccm/h). For normalization of the measured electrolyte (potassium chloride) concentration (g/ccm), a theoretical reference concentration $c_0$ was chosen which would occur if the total amount of potassium chloride (g) used as tracer would have at once and uniformly been distributed over the entire liquid volume content (ccm) of the respective mixing device.

A comparison of the test results, depicted in FIG. 10, show a substantially improved approximation of ideal plug flow for the invented apparatus (curve A) than is obtained with either the helix-like mixing elements according to U.S. Pat. No. 3,286,992 (curve B) or the empty pipe (curve C). Of particular advantage for certain process engineering applications is the considerably reduced fraction of material remaining for a longer time in the mixing device. This feature is represented by a significantly steeper decent of the right-hand shoulder of curve A compared to curves B or C.

EXAMPLE 2

Efficiency of mixing:

A. For proving the suitability of the invented apparatus as a device for mixing fluids of largely differing dynamic viscosities, water having a viscosity of about one centipoise was at various ratios mixed with a water-soluble resin having a viscosity of about 2750 centipoise.

The mixing device consisted of 1000 mm long, vertically mounted Plexiglass tube of 42 mm internal diameter which contained 19 mixing elements of the configuration shown in FIG. 6 with baffles 4 and 5 of each mixing element having the following dimensions:

Up to the first mixing element, tube 3 was divided by an impermeable wall into two separate flow passages of about semi-circular crossection. Through these channels the two different components were fed to the mixing section of the apparatus at different ratios but a constant total volume flow rate of about 500 liters/-hour. Despite the relatively low mean flow velocity of only about 0.1 meter/second and the relative large viscosity ratio of 1:2750 of the components, a homogeneous, Schlieren-free mixture was obtained at all mixing of the components ranging from 10:1 to 1:10 parts by volume. According to pertinent literature relating to prior art, viscosity ratios of the components exceeding a value of 100 should be avoided. With the mixing apparatus of the present invention, however, a viscosity ratio of 1:2750 yielded, over a wide range of mixing ratios of the two fluid streams, a homogeneous mixture.

B. For determining the number of mixing elements necessary to obtain a homogeneous mixture, a reactive fluid was used consisting of an epoxy resin (epichlorhydrin-bisphenol A polymer) and a resinous amine adduct as curing agent. During the curing process the amine adduct crosslinks with the epoxy resin to form a more or less solidified final product. In a mixing device similar to that described in previous section A, but equipped with 30 mixing elements, two streams of the above reactive fluid were blended with each other, one stream being marked by added white pigment, while the other was marked by an addition of black pigment. At some time after the start of the blending operation the black and white feed streams to the mixing device were suddenly stopped. After an appropriate curing time the product-filled mixing tube was sliced normal to the longitudinal axis of the tube between each two mixing elements. The degree of blending was then determined from the uniformity of the gray tone across each successive crossectional cut. After the nineteenth mixing element no more black and white striations of differences in gray tone were visible across the entire crossectional cut, that is, after a mixing-length corresponding to about 13.5 times the internal diameter of tube 3 the homogenizing of the two components was completed.

It is apparent from the foregoing specification that the present invention is susceptible of being embodied with various alterations and modifications which may differ particularly from those that have been described in the preceeding specification and description. For this reason, it is fully to be understood that all of the foregoing is intended to be merely illustrative and is not to be construed or interpreted as being restrictive or otherwise limiting of the present invention.

What is claimed is:

1. A device for mixing a plurality of fluid material streams, said device comprising:

a flow-bounding tube;

a plurality of consecutively arranged mixing elements of equal spatial configuration positioned within said tube between its inlet and outlet ends;

each of said mixing elements comprising an outer baffle having its minor axis normal to the longitudinal axis of the tube, its major axis angularly disposed with respect to the longitudinal axis of the tube, its outer peripheral contour substantially in contact with the internal wall surface of the tube, and an orifice-like opening formed at its center;

each of said mixing elements further comprising an inner baffle positioned within said orifice-like opening in a manner such that the minor axes of said outer and inner baffles coincide and that the angle formed by said outer and inner baffles includes the longitudinal axis of the tube.

2. The device of claim 1 wherein consecutive mixing elements face each other with their respective outer and inner baffles being angularly disposed about the longitudinal axis of the tube at an angle of about 180° in a mannaer such that an inner baffle of one mixing element is substantially opposite the outer baffle of the next consecutive mixing element.

3. The device of claim 2 wherein said mixing elements are emboxed about the longitudinal axis of the tube in a manner such that the inner baffle of one mixing element partly penetrates the orifice-like opening of the next consecutive mixing element and that the line of connection between the points of contact of an inner baffle of one mixing element and the outer baffle of the next consecutive mixing element is subtantially parallel to the minor axis of each of said mixing elements.

4. The device of claims 3 wherein the shape of said inner baffle corresponds to that of the of the orifice-like opening formed in said outer baffle.

5. The device of claim 1 wherein said outer and inner baffles terminate at a boundary line located generally along their mutual minor axes.

6. The device of claim 5 wherein consecutive mixing elements face each other with their respective outer and inner baffles being angularly disposed about the longitudinal axis of the tube at an angle of about 90° in a manner such that the outer and inner baffles of one mixing element contact the next consecutive mixing element substantially along the boundary line of its outer and inner baffles.

7. The device of claim 5 wherein the consecutive mixing elements are emboxed about the longitudinal axis of the tube in a manner such that the inner baffle of one mixing element partly penetrates the orifice-like opening of the next consecutive mixing element and wherein consecutive pairs of emboxed mixing elements face each other with their respective pairs of outer and inner baffles being angularly disposed about the longitudinal axis of the tube at an angle of about 90° in a manner such that the boundary line of one set of outer and inner baffles of a first pair of emboxed mixing elements will contact the next consecutive pair of emboxed mixing elements substantially at a point of intersection along the boundary line of one of its sets of outer and inner baffles and the other set of outer and inner baffles of said first pair of emboxed mixing elements will contact said next consecutive pair of emboxed mixing elements substantially along said same boundary line of one of its sets of outer and inner baffles.

8. The device of claim 7 further comprising flow-guiding surfaces extending from each of the boundary lines of said mixing elements parallel to the longitudinal axis of the tube, the width of said flow-guiding surfaces being substantially equal to the internal diameter of said tube.

9. The device of claim 8 wherein at least one of two adjacent flow-guiding surfaces facing each other as a part of consecutive, angularly disposed mixing elements is provided with a slot for inserting the next consecutive, opposite flow-guiding surface at their point of contact.

10. The device of claim 7 wherein the relative position of said consecutive mixing elements are fixed by permanently joining said baffles at their points of contact with the next consecutive mixing elements.

11. The device of claim 5 wherein said boundary lines are formed a sharp, knife-like edges.

* * * * *

UNITED STATES PATENT AND TRADEMARK OFFICE
CERTIFICATE OF CORRECTION

PATENT NO. : 4,019,719
DATED : April 26, 1977
INVENTOR(S) : Hans H. Schuster et al.

It is certified that error appears in the above-identified patent and that said Letters Patent are hereby corrected as shown below:

In Column 1, Line 31, delete " pp. 1051-56" and substitute -- pp. 348-54 --

In Column 1, Line 32, "Chemie-Ing. Techn." should be in italic.

In Column 1, Line 34, delete "Hyby" and substitute --Hiby--

In Column 5, Line 41, delete " practially " and substitute -- practically --

In Column 6, Line 51, delete " priniciples " and substitute -- principles --

In Column 9, Line 16, delete " mannaer " and substitute -- manner --

In Column 1, Line 24, delete " ..., (May 1, 1969) ... " and substitute -- ..., (May 19, 1969) ... --

UNITED STATES PATENT OFFICE

CERTIFICATE OF CORRECTION

Patent No. 4,019,719 Dated April 26, 1977

Inventor(s) Hans H. Schuster et al.

It is certified that error appears in the above-identified patent and that said Letters Patent are hereby corrected as shown below:

In Column 4, Line 3, delete " ... between 30 and 60 . " and substitute -- ... between 30° and 60° . --

In Column 4, Line 54, after " FIG. 1 and 2. " a paragraph should begin with " A further improvement ... "

In Column 5, Line 64, delete " interconenction " and substitute -- interconnection --

In Column 8, Line 12, delete " ... ratios but a ... " and substitute -- ... ratios but at a ... --

In Column 8, Line 18, before the word "of" insert -- ratios --

In Column 8, Line 45, delete "of" and insert --or--

In Column 10, Line at the bottom, delete "a" and substitute --as--

Signed and Sealed this nineteenth Day of July 1977

[SEAL]

Attest:

RUTH C. MASON
Attesting Officer

C. MARSHALL DANN
Commissioner of Patents and Trademarks